US006910433B2

(12) United States Patent
Nishikawa et al.

(10) Patent No.: US 6,910,433 B2
(45) Date of Patent: Jun. 28, 2005

(54) PRESSER DEVICE FOR A SEWING MACHINE

(75) Inventors: Masahiko Nishikawa, Osaka (JP); Takashi Kasuda, Osaka (JP); Junji Kawakami, Osaka (JP)

(73) Assignee: Pegasus Sewing Machine Mfg. Co. Ltd., Osaka (JP)

( * ) Notice: Subject to any disclaimer, the term of this patent is extended or adjusted under 35 U.S.C. 154(b) by 0 days.

(21) Appl. No.: 10/825,162

(22) Filed: Apr. 16, 2004

(65) Prior Publication Data

US 2004/0221782 A1 Nov. 11, 2004

(30) Foreign Application Priority Data

Apr. 16, 2003 (JP) ..... 2003-110948

(51) Int. Cl.[7] ..... D05B 29/00
(52) U.S. Cl. ..... 112/235
(58) Field of Search ..... 112/235, 236, 112/237, 238, 239, 240, 60

(56) References Cited

U.S. PATENT DOCUMENTS 5,461,997 A * 10/1995 Landen ..... 112/237
6,637,357 B2 * 10/2003 Choi ..... 112/162

OTHER PUBLICATIONS

Japanese Utility Model Publication No. 6–16604.

* cited by examiner

*Primary Examiner*—Peter Nerbun
*Assistant Examiner*—Brian Kauffman
(74) *Attorney, Agent, or Firm*—Bacon & Thomas

(57) ABSTRACT

A push-up lever is rotatably supported on a sewing machine frame, and a coupling lever is coupled to the push-up lever. An oscillating shaft is rotatably supported on a bush, and the coupling lever is engaged with a part of the oscillating shaft. A presser base is coupled to a crank piece of the oscillating shaft, and a presser foot is fixed at its leading end. An elastic member engaged with the presser base. A bracket changeable in fixing position is supported on the back side of the sewing machine frame, and the bush is fixed in the bracket. The crank piece of the oscillating shaft is separable in two pieces, and the engaging faces of the two separated crank pieces are fixed anew when changing the fixing position of the bracket. Therefore, the circular track of the presser foot near the platform of the sewing machine bed can be changed easily, and an eccentric portion of the crank piece is not changed from an initial setting position.

7 Claims, 7 Drawing Sheets

PRESSER DEVICE FOR A SEWING MACHINE

BACKGROUND OF THE INVENTION

1. Field of the Invention

The present invention relates to a presser device for a sewing machine, which is configured to engage with a cloth from above and press the cloth to a platform.

2. Description of the Prior Art

In a conventional presser device for a sewing machine, for example, as disclosed in Japanese Utility Model Publication No. H6-16604, an oscillating shaft coupled to a presser base is supported by a bush fixed on a sewing machine frame. A presser foot fixed to the leading end of the presser base is pressed beneath a presser spring device (presser bar), that is, to the side of a workpiece support member (platform of a sewing machine bed).

In such conventional presser device for a sewing machine, however, since the bush supporting the oscillating shaft is fixed on the sewing machine frame, the circular track of the presser foot near the platform of the sewing machine bed cannot be changed. As a result, when sewing a cloth different in type or thickness, the presser foot may disturb conveyance of the cloth.

To change the circular track, the fixing position of the presser foot may be deviated on the presser base, but when the fixing position is deviated, the presser foot is dislocated from the sewing position of the sewing machine, and appropriate sewing by the sewing machine is disturbed.

SUMMARY OF THE INVENTION

It is hence an object of the present invention to provide a presser device for a sewing machine capable of changing easily the circular track of the presser foot near the platform of the sewing machine bed, and utilizing the existing parts to the maximum extent when changing the circular track of the presser foot.

The present invention comprises a push-up lever, a coupling lever, an oscillating shaft, a presser base, and an elastic member. The push-up lever is rotatably supported at the back side of a sewing machine frame, and is forced in one direction by a spring. The coupling lever is coupled to the push-up lever. The oscillating shaft is rotatably supported on a bush, and a part thereof is engaged with the coupling lever. The presser base is coupled to a crank piece formed in part of the oscillating shaft by a pin, and the presser foot is fixed at its leading end. The elastic member is engaged with the presser base. In the presser device for a sewing machine having structure, the leading end of the presser base is elastically forced downward about the oscillating shaft by the elastic member, and the cloth is pressed to the platform of the sewing machine bed.

It is a first feature of the present invention that a bracket for fixing the bush is provided detachably on the back side of the sewing machine frame and changeable vertically in the fixing position, and that the crank piece of the oscillating shaft is separable in two pieces. The engaging faces of the two separated crank pieces are fixed anew by deviating by 180 degrees when changing the fixing position of the bracket. As a result, the eccentric portion of the crank piece is not changed from the initial setting position.

By separating the crank piece into right and left halves, the engaging faces of the two separated crank pieces are preferably fixed by a plurality of screws. At this time, in the crank piece or plurality of screws positioned at the side of the oscillating shaft, the support part for other crank piece should be provided. Or the support part for other crank piece may be detachably disposed on the crank piece positioned at the oscillating shaft side.

Alternatively, by separating the crank piece into upper and lower halves, the crank piece positioned at the oscillating shaft side may be composed to have engaging faces above and beneath. At this time, a tubular gripping portion is attached to the crank piece positioned at the oscillating shaft side, while a convex protrusion is formed in the other separated crank piece. By fitting the both parts, the two separated crank pieces may be fixed together.

It is a second feature of the present invention that a bracket for fixing the bush is provided detachably on the back side of the sewing machine frame and changeable vertically in the fixing position, and that the crank piece of the oscillating shaft can be separated from the oscillating shaft. A plurality of fixing positions are provided in the crank piece, and the crank piece is fixed anew by deviating on the oscillating shaft when changing the fixing position of the bracket. In this configuration, too, the eccentric portion of the crank piece is not changed from the initial setting position.

According to the present invention, a detachable bracket is provided at the back side of the sewing machine frame, and the bush is fixed on the bracket, and hence the circular track of the presser foot near the platform of the sewing machine bed can be easily changed. That is, since the circular track of the presser foot near the platform of the sewing machine bed can be easily changed, when sewing a cloth different in type or thickness, the presser foot never disturbs conveyance of cloth.

In addition, since the crank piece of the oscillating shaft is separable in two halves, by fixing anew the two separated crank pieces when changing the fixing position of the bracket, the eccentric portion of the crank piece is not changed from the initial setting position. As a result, the initial setting position of the presser foot side is not changed, and it is not required to replace the related parts with other corresponding parts in the presser device for the sewing machine.

By fixing the two separated right and left crank pieces by a plurality of screws, a secure fixing force is obtained, and a further secure fixing force is obtained by disposing the support part for other crank piece in the crank piece or plurality of screws positioned at the oscillating shaft side.

Moreover, the crank piece of the oscillating piece may be separate from the oscillating shaft and a plurality of fixing positions may be provided in the crank piece, and by deviating the crank piece to the oscillating shaft and fixing anew when changing the fixing position of the bracket, the eccentric portion of the crank piece may not be changed from the initial setting position.

DETAILED DESCRIPTION OF THE PREFERRED EMBODIMENTS

Figure 1:
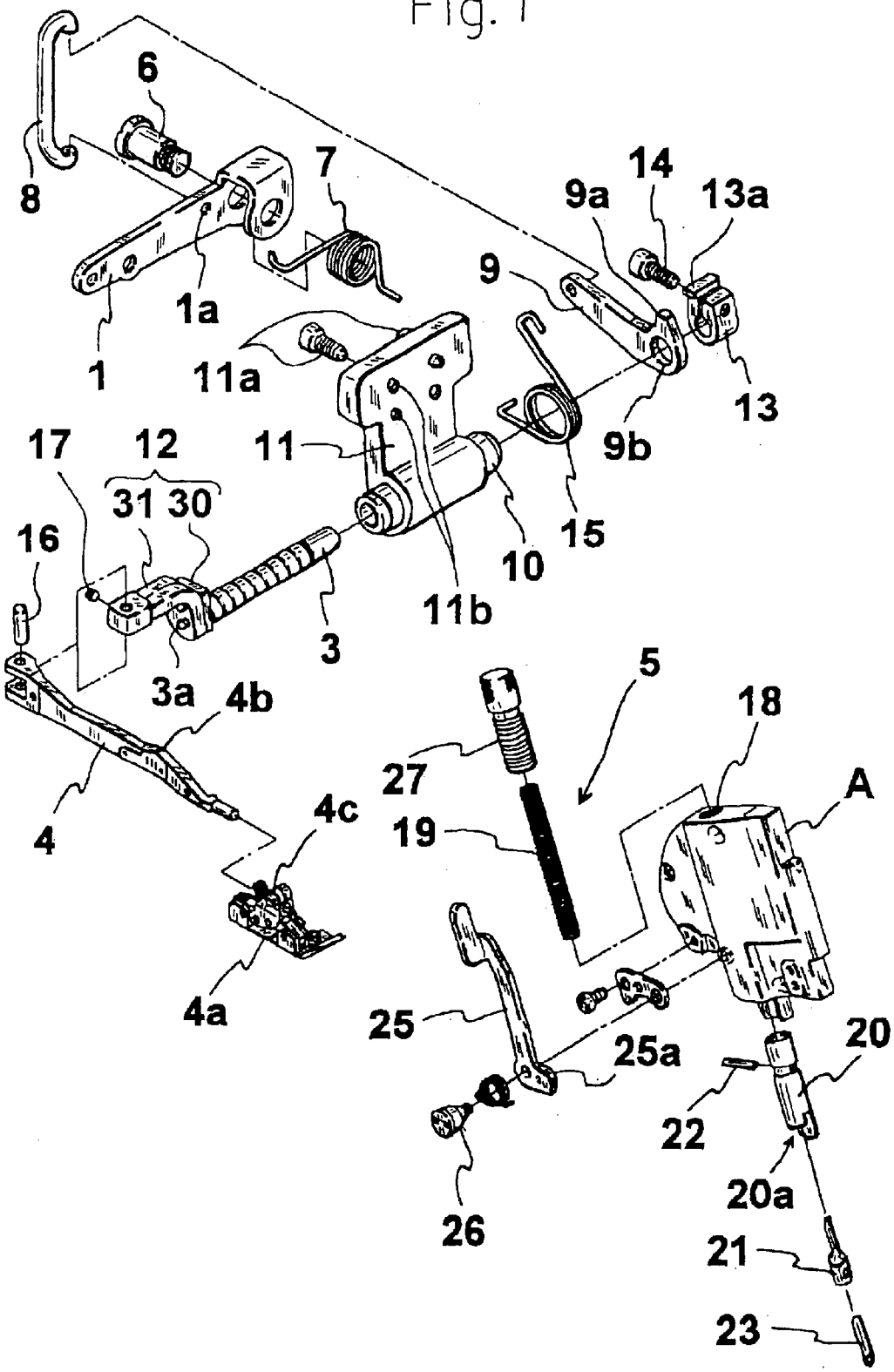
FIG. 1 is a perspective exploded view of presser device for a sewing machine according to the present invention.
Figure 2:
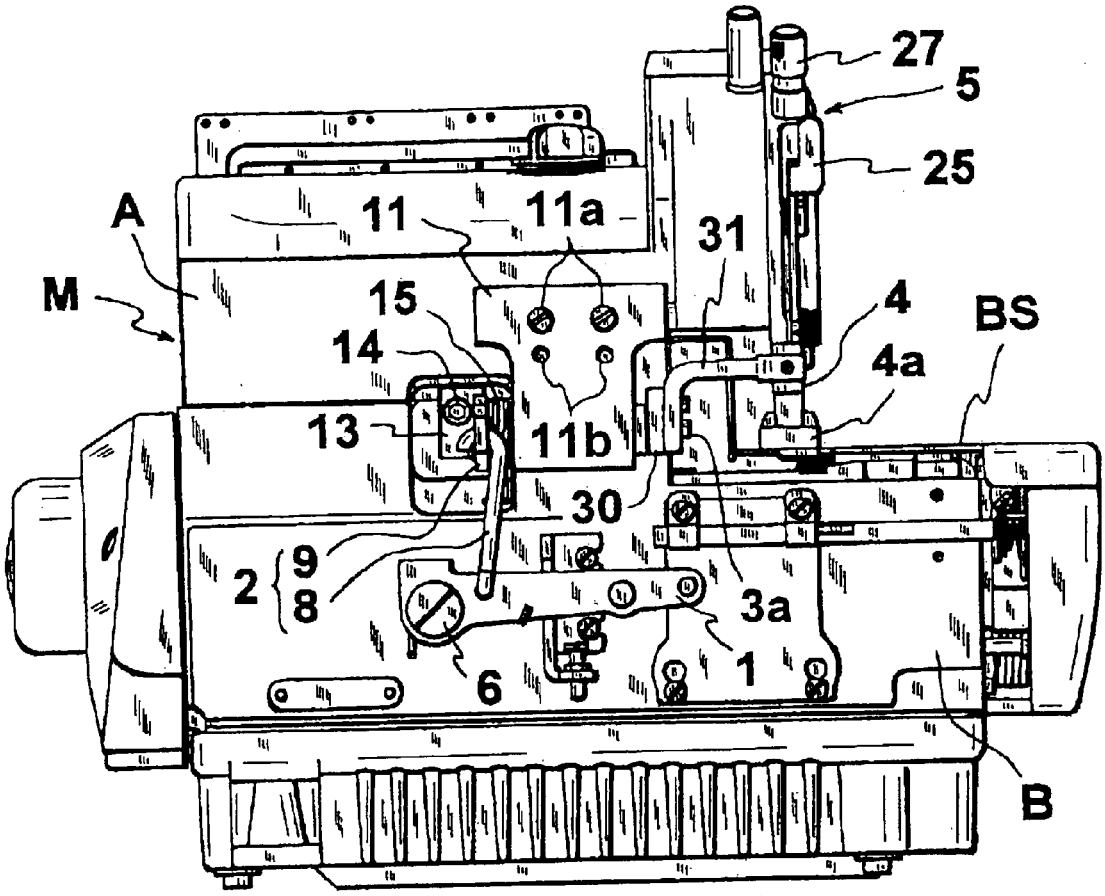
FIG. 2 is a rear view of the sewing machine having the presser device according to the present invention.
Figure 3:
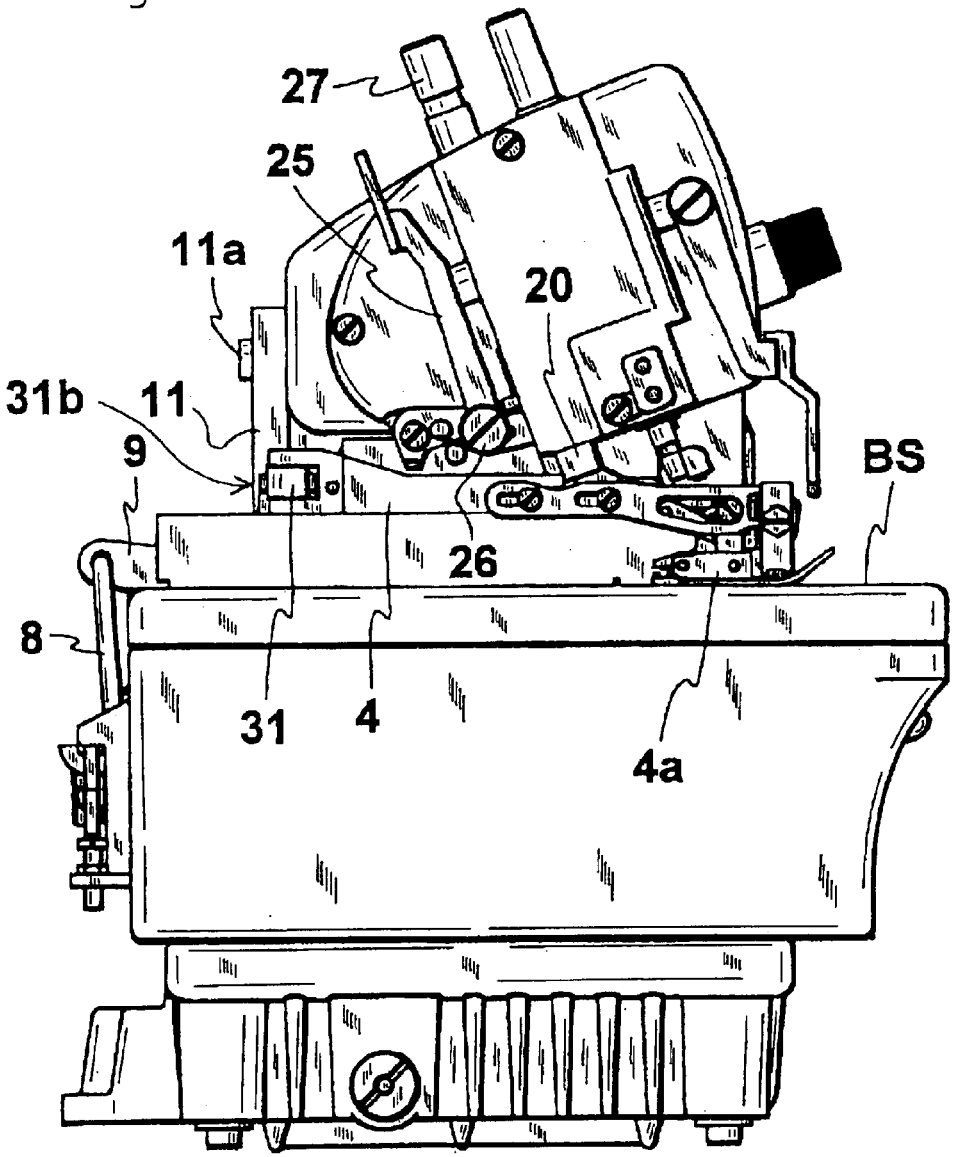
FIG. 3 is a left side view of the sewing machine having the presser device according to the present invention.

Referring now to the drawings, preferred embodiments of the present invention are described specifically below.

A presser device for a sewing machine comprises a push-up lever 1, a coupling lever 2, an oscillating shaft 3, a presser base 4, and an elastic member 5. The push-up lever 1 has a hole 1*a* for mounting the coupling lever, and the base end of said lever 1 is rotatably supported at the back side of the sewing machine frame M by a stepped screw 6. A spring 7 is inserted into the stepped screw 6 together with the push-up lever 1. One end of the spring 7 is fixed on the sewing machine frame M, and other end is fixed in the lower part of the push-up lever 1. The coupling lever 2 includes a hook 8 and an arm 9, and both members 8, 9 are coupled together. The hook 8 is fitted into the hole 1*a* of the push-up lever 1. The arm 9 has a pawl 9*a* and a hole 9*b*.

The oscillating shaft 3 is rotatably inserted into the hole 9*b* of the arm 9. The oscillating shaft 3 is rotatably supported in a bush 10, and the bush 10 is fixed to a bracket 11. The bracket 11 is fixed to the back side of the sewing machine frame M by screws 11*a*. That is, the bracket 11 is detachable from the sewing machine frame M. Screw holes 11*b*, 11*b* of the bracket 11 are formed in upper and lower positions, and by using properly the inserting of screws 11*a* into the upper or lower position, the bracket 11 can be changed in the fixing position on the sewing machine frame M.

Figure 4:
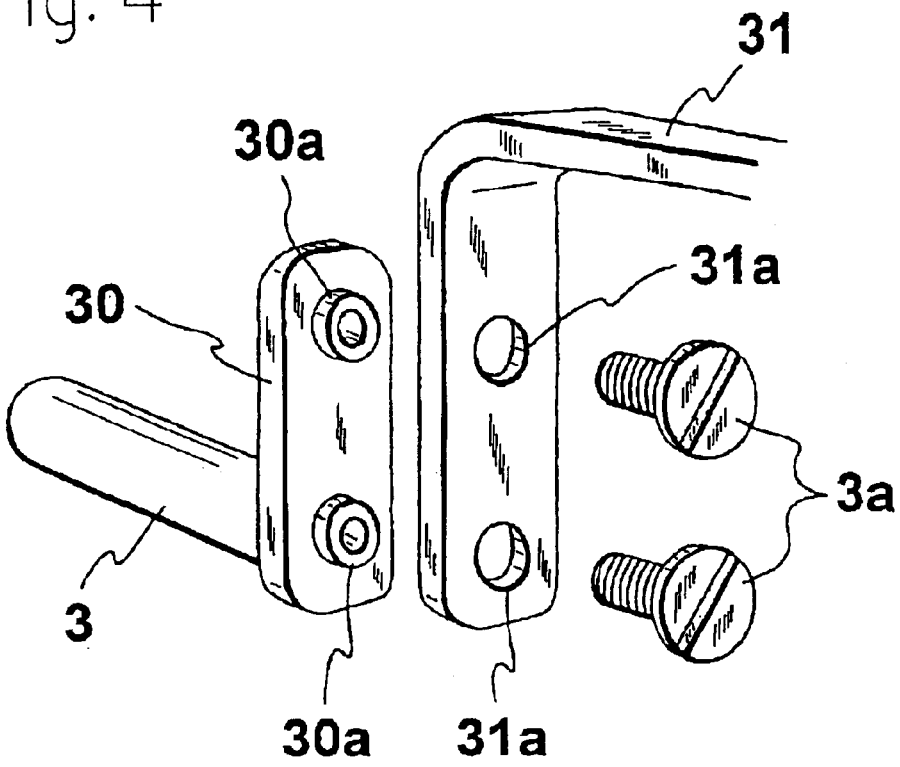
FIG. 4 is a perspective exploded view showing a fixing portion of oscillating shaft crank piece of presser device according to the present invention.

The oscillating shaft 3 has a crank piece 12 at one end thereof, and a collar 13 is fitted to other end of the oscillating shaft 3 by a screw 14. The crank piece 12 can be separated into right and left halves, and a separated crank piece 31 is fixed to the crank piece 30 at the oscillating shaft side by a plurality of screws 3*a*. That is, the engaging faces of the both crank pieces 30, 31 are mutually fixed by the plurality of screws 3*a*. The crank piece 30 at the oscillating shaft side has a plurality of support parts 30*a*, 30*a* as shown in FIG. 4. The support parts 30*a*, 30*a* are fitted so as to contact tightly with holes 31*a*, 31*a* of the separated crank piece 31.

A spring 15 is inserted in the bush 10. One end of the spring 15 is fixed on the sewing machine frame M, and other end is fixed in the lower part of the arm 9. By the action of springs 7, 15, the push-up lever 1 is elastically forced in one direction, and a restoring force is given to the push-up lever 1 rotated by a foot pedal or the like. When the push-up lever 1 is rotated by the foot pedal or the like, the pawl 9*a* of the arm 9 is engaged with a latch 13*a* of the collar 13 fixed on the oscillating shaft, that is, a part of the oscillating shaft 3, so that the oscillating shaft 3 rotates about the axial center.

A pin 16 is fixed to the separated crank piece 31 by a worm screw 17. The presser base 4 is rotatably coupled to the separated crank piece 31 through the pin 16. A presser foot 4*a* is fixed to the leading end of the presser base 4 by a screw 4*c*. When loosening the screw 4*c*, the presser foot 4*a* can change the fixing position on the presser base 4 in the longitudinal direction. The elastic member 5 is disposed in the midst of the presser base 4. The elastic member 5 is provided in a tubular body 18 inserted in the sewing machine arm A, and has a coil spring 19 and a bifurcate rod 20. The coil spring 19 is inserted into the tubular body 18. The bifurcate rod 20 is hollow, and the lower end of the rod 20 has a dent 20*a*. This dent 20*a* has a guide surface for guiding the right and left sides of the presser base 4.

In the hollow space of the bifurcate rod 20, an engaging piece 21 for the coil spring 19 is fixed by a stopper 22. The lower end of the engaging piece 21 is positioned deeper than the dent 20*a* of the bifurcate rod, and a pin 23 is interposed in this space. The upper side of the presser base 4 has a groove 4*b*, and the lower end of the pin 23 is engaged with the groove 4*b* of the presser base 4. A manual lever 25 is fitted to the sewing machine arm A by a stepped screw 26. By rotating the manual lever 25, a pawl 25*a* of the manual lever 25 is engaged with the stopper 22 of the bifurcate rod 20, and the pressing force on the presser base 4 by the bifurcate rod 20 is released. The pressing force of the coil spring 19 on the bifurcate rod 20 is adjusted by turning an adjusting screw 27. The elastic member 5 forces the leading end of the presser base 4 downward around the oscillating shaft. As a result, the presser foot 4*a* fixed to the leading end of the presser base 4 presses the cloth to a platform BS of the sewing machine bed B.

Figure 5:
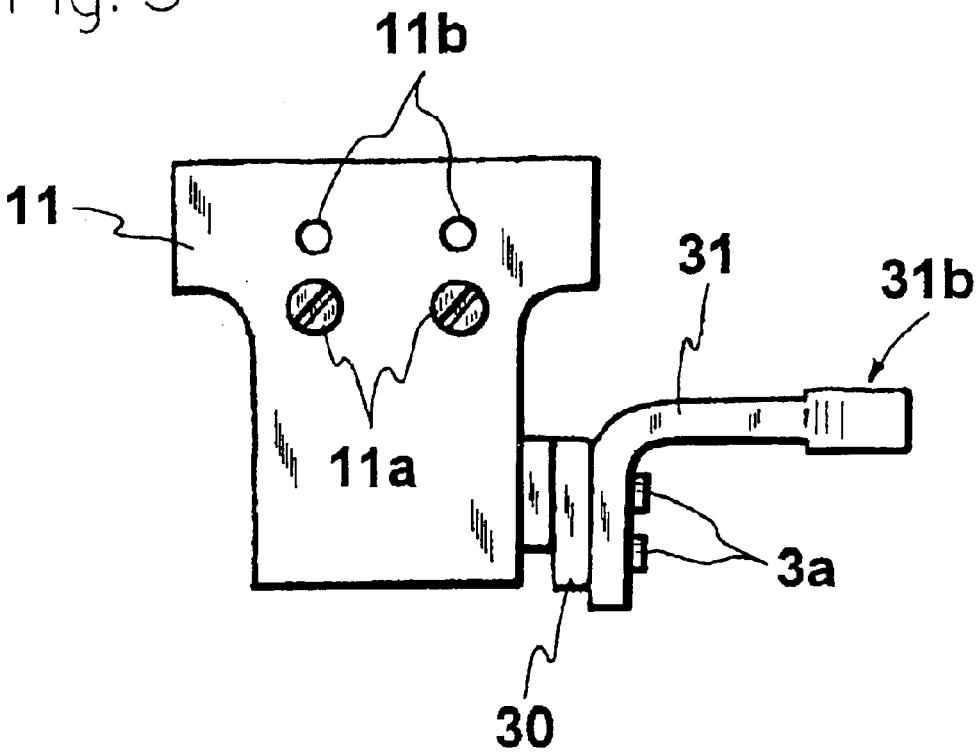
FIG. 5 is an explanatory diagram showing a coupling state of bracket and oscillating shaft crank piece of presser device according to the present invention.
Figure 6:
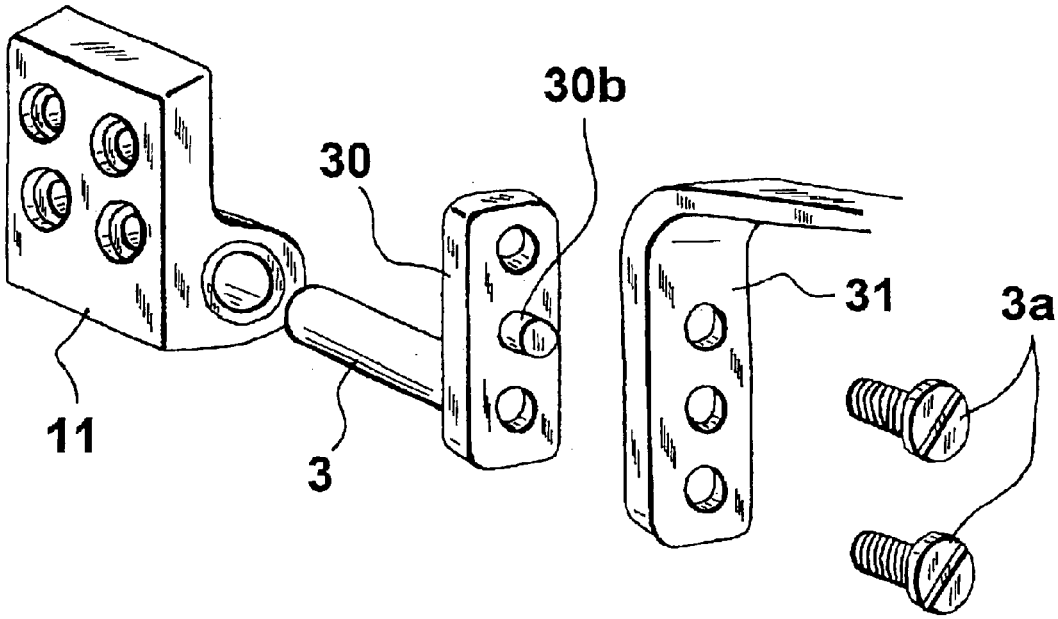
FIG. 6 is a perspective exploded view showing a modified example of the fixing portion of presser device according to the present invention.

When changing the fixing position of the bracket 11, the screw 3*a* is loosened preliminarily, and the crank piece 12 of the oscillating shaft is separated into two halves. At this time, the crank piece 30 at the oscillating shaft side deviates by 180 degrees, as shown in FIG. 5, the crank piece 30 is fixed anew on the separated crank piece 31. As a result, the flat part 31*b* of the crank piece is not changed from the initial setting position. That is, when the mutual engaging faces of the two separated crank pieces 30, 31 are fixed anew when changing the fixing position of the bracket 11, the initial setting position in the eccentric part 31*b* of the crank piece remains unchanged from the sewing machine frame M. As shown in FIG. 6, meanwhile, when a fixing pin 30*b* is provided in the crank piece 30 at the oscillating shaft side, by rotating the crank piece 30 by 180 degrees, the separated crank piece 31 may be rotated about the fixing pin 30*b*.

Figure 7:
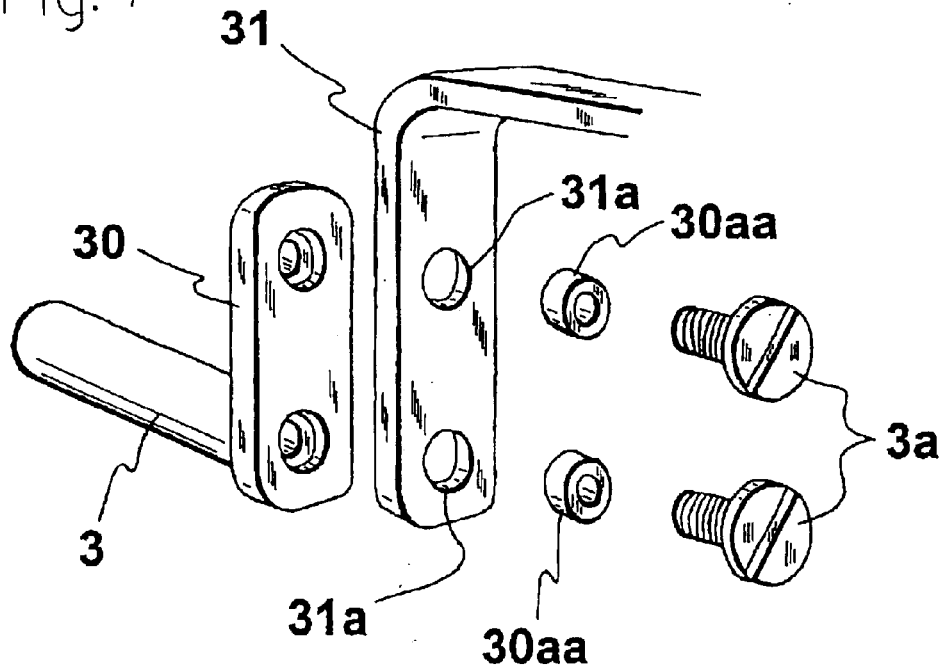
FIG. 7 is a perspective exploded view showing a modified example of the fixing portion of presser device according to the present invention.

In this preferred embodiment, the support part is integrally provided in the crank piece at the oscillating shaft side, but the structure is not limited to this example alone. For example, as shown in FIG. 7, support parts 30*aa*, 30*aa* may be formed detachably, support parts 30*aa*, 30*aa* may be fixed by screws 3*a*. Also, the screws 3*a* may be changed to stepped screws, and the steps of the stepped screws may be used instead of the support parts 30*aa*, 30*aa*.

Figure 8:
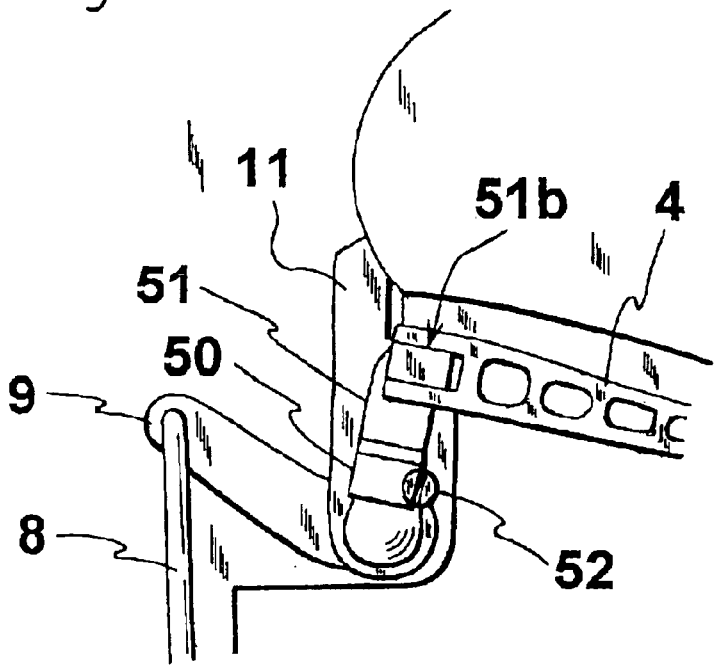
FIG. 8 is a left side view of a sewing machine having a presser device in other embodiment according to the present invention.
Figure 9:
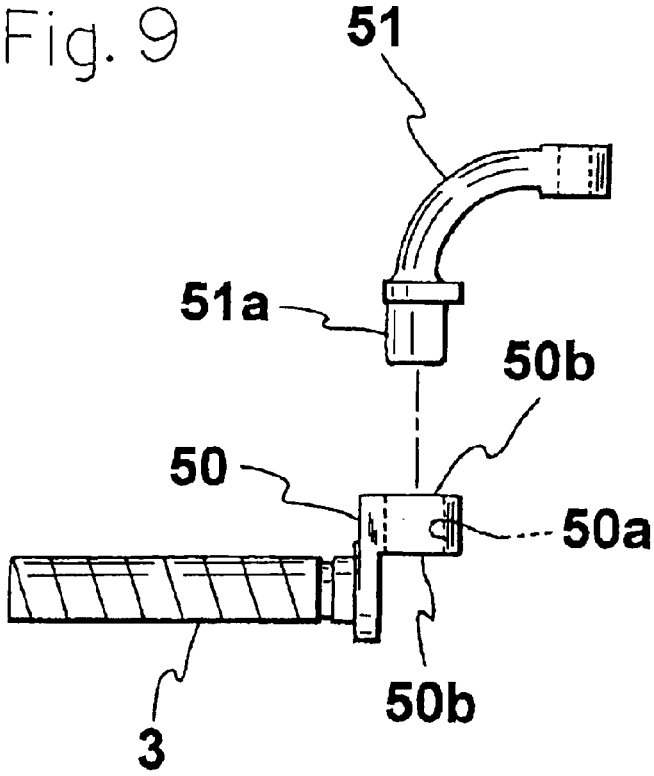
FIG. 9 is an exploded view showing an oscillating shaft crank piece in a different embodiment.

In the preferred embodiment, the crank piece is separated into right and left halves, but not limited to this example, it may be separated into upper and lower halves. The two separated upper and lower crank pieces and peripheral structure are explained below. Crank pieces 50, 51 are two separated upper and lower ones as shown in FIG. 8. As shown in FIG. 9, a tubular gripping part 50*a* is attached to the crank piece 50 at the oscillating shaft side. The upper and lower sides of the gripping part 50*a* are the engaging faces 50*b*, 50*b*, while the other separated crank piece 51 has a round (convex) protrusion 51*a*. Holding force of the gripping part 50*a* can be adjusted by a screw 52, and by fitting the both parts 50*a*, 51*a*, the two separated crank pieces are fixed together.

In the case of the presser device having such structure, the crank piece 50 at the oscillating shaft side rotates by 180 degrees when changing the fixing position of the bracket 11, thereafter, it is fixed anew on the separated crank piece 51. That is, the upper and lower engaging faces 50*b*, 50*b* formed on the crank piece 50 at the oscillating shaft side are changed over when changing the fixing position of the bracket 11, and are brought into contact with the engaging face of the separated crank piece 51, so that the eccentric portion 51*b* of the crank piece is not changed from the initial setting position.

Figure 10:
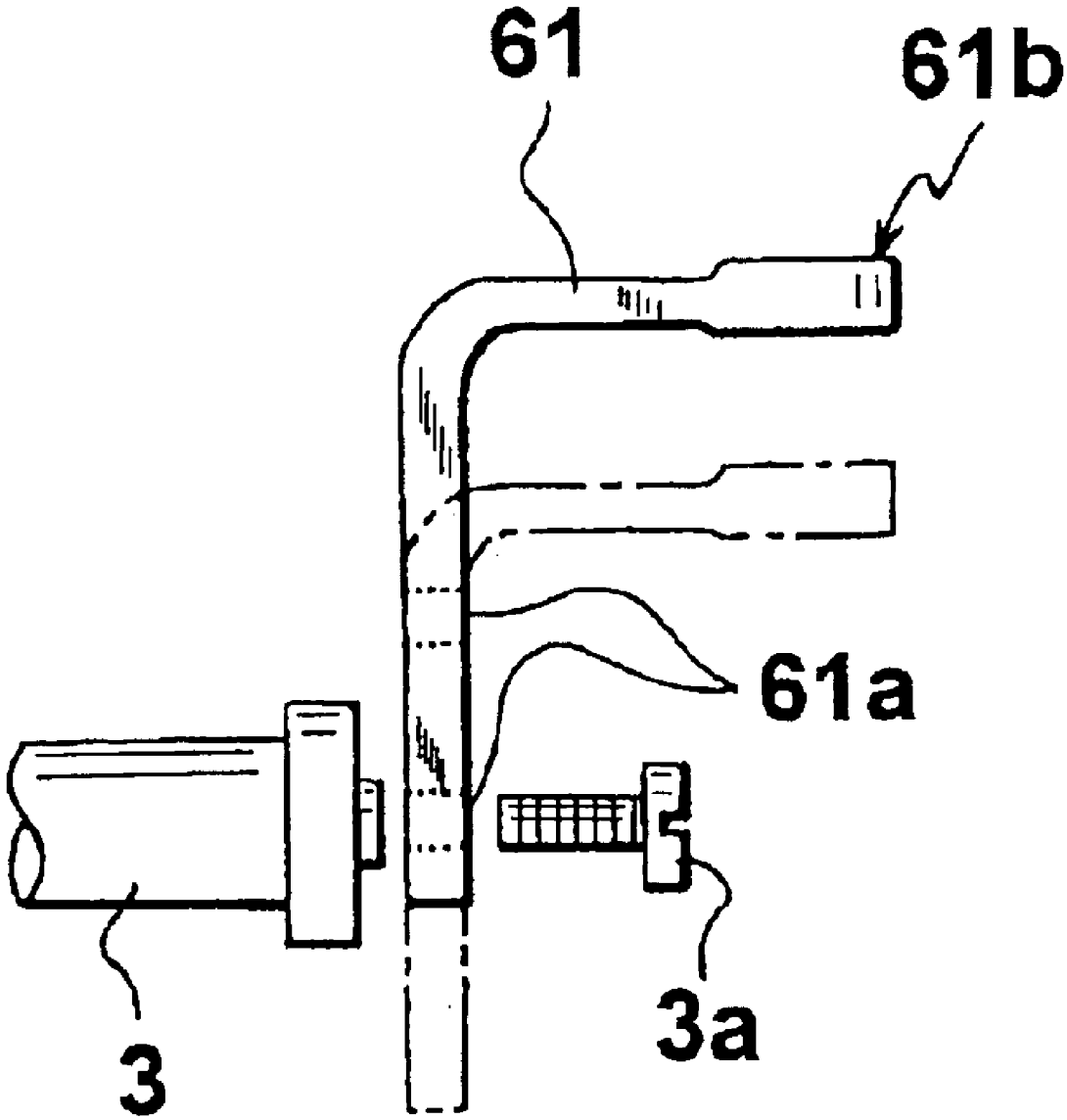
FIG. 10 is an explanatory diagram of a further different embodiment of an oscillating shaft and crank piece.

Also in this preferred embodiment, the crank piece of the oscillating shaft is separated into two section, but not limited to this structure, for example, the oscillating shaft and crank piece may be separate from each other. At this time, as shown in FIG. 10, a crank piece 61 has a plurality of fixing positions 61*a*, 61*a*, and the crank piece 61 is shifted and fixed anew on the oscillating shaft 3 when changing the fixing position of the bracket 11, so that an eccentric portion 61*b* of the crank piece is not changed from the initial setting position. In such structure, since it is not needed to rotate the oscillating shaft 3 by 180 degrees, it is not required to adjust again the coupling portion at the coupling lever 2 side. In the structure shown in FIG. 10, when a longitudinal groove is provided at the end of the oscillating shaft 3 side, the crank piece 61 can be guided from both sides, and a sufficient fixing force is obtained.

What is claimed is:

1. A presser device for a sewing machine comprising:

a push-up lever rotatably supported at the back side of a sewing machine frame, said push-up lever being forced in one direction by a spring, a coupling lever coupled to the push-up lever, an oscillating shaft rotatably supported on a bush, with a part of the oscillating shaft being engaged with the coupling lever, a presser base coupled to a crank piece of the oscillating shaft through a pin, with a presser foot being fixed at the leading end of the presser base, and an elastic member engaged with the presser base, whereby the leading end of the presser base is elastically forced downward about the oscillating shaft by the elastic member, and the cloth is pressed to a platform of the sewing machine bed, said device is characterized in that a bracket is supported on the back side of the sewing machine frame detachably and changeably in a fixing position vertically, said bush is fixed in the bracket, said crank piece of the oscillating shaft is separable in two pieces, and the engaging faces of the two separated crank pieces are fixed anew by deviating by 180 degrees when changing the fixing position of the bracket, so that an eccentric portion of the crank piece is not changed from an initial setting position.

2. A presser device for a sewing machine as claimed in claim 1, wherein said crank piece is separable into right and left halves, and the engaging faces of the two separated crank pieces are fixed by a plurality of screws.

3. A presser device for a sewing machine as claimed in claim 2, wherein the crank piece or plurality of screws positioned at the side of the oscillating shaft are provided with support parts for other crank piece.

4. A presser device for a sewing machine as claimed in claim 3, wherein the support parts for other crank piece are detachably disposed on the crank piece positioned at the oscillating shaft side.

5. A presser device for a sewing machine as claimed in claim 1, wherein said crank piece is separable into upper and lower halves, and the crank piece at the oscillating shaft side has upper and lower engaging faces.

6. A presser device for a sewing machine as claimed in claim 5, wherein a tubular gripping portion is attached to the crank piece at the oscillating shaft side, and a convex protrusion is formed in the other separated crank piece, and by fitting the both of tubular gripping portion and convex protrusion, the two separated crank pieces are fixed together.

7. A presser device for a sewing machine comprising:

a push-up lever rotatably supported at the back side of a sewing machine frame, said push-up lever being forced in one direction by a spring, a coupling lever coupled to the push-up lever, an oscillating shaft rotatably supported on a bush, with a part of the oscillating shaft being engaged with the coupling lever, a presser base coupled to a crank piece of the oscillating shaft through a pin, with a presser foot being fixed at the leading end of the presser base, and an elastic member engaged with the presser base, whereby the leading end of the presser base is elastically forced downward about the oscillating shaft by the elastic member, and the cloth is pressed to a platform of the sewing machine bed, said device is characterized in that a bracket is supported on the back side of the sewing machine frame detachably and changeably in a fixing position vertically, said bush is fixed in the bracket, said crank piece of the oscillating shaft can be separated from the oscillating shaft, the crank piece has a plurality of fixing positions, and the crank piece is deviated and fixed anew on the oscillating shaft when changing the fixing position of the bracket, so that an eccentric portion of the crank piece is not changed from an initial setting position.

* * * * *

UNITED STATES PATENT AND TRADEMARK OFFICE

CERTIFICATE OF CORRECTION

PATENT NO. : 6,910,433 B2
DATED : June 28, 2005
INVENTOR(S) : Masahiko Nishikawa et al.

It is certified that error appears in the above-identified patent and that said Letters Patent is hereby corrected as shown below:

Column 6,
Line 2, replace “piece” with -- pieces --.

Signed and Sealed this

Third Day of January, 2006

JON W. DUDAS
*Director of the United States Patent and Trademark Office*